US008448713B2

(12) United States Patent
Munshi et al.

(10) Patent No.: US 8,448,713 B2
(45) Date of Patent: May 28, 2013

(54) INFLATABLE TOOL SET WITH INTERNALLY GENERATED GAS

(75) Inventors: Ammar A. Munshi, Sugar Land, TX (US); Amy L. Farrar, Houston, TX (US)

(73) Assignee: Baker Hughes Incorporated, Houston, TX (US)

( * ) Notice: Subject to any disclaimer, the term of this patent is extended or adjusted under 35 U.S.C. 154(b) by 0 days.

(21) Appl. No.: 13/110,528

(22) Filed: May 18, 2011

(65) Prior Publication Data

US 2012/0292013 A1 Nov. 22, 2012

(51) Int. Cl.
*E21B 33/12* (2006.01)

(52) U.S. Cl.
USPC ..... 166/387; 166/179; 166/300; 166/243

(58) Field of Classification Search
USPC ..... 166/387, 179, 300, 243
See application file for complete search history.

(56) References Cited

U.S. PATENT DOCUMENTS

| | | | | |
|---|---|---|---|---|
| 3,264,994 | A | 8/1966 | Leutwyler | |
| 7,178,603 | B2 | 2/2007 | Naquin, Sr. et al. | |
| 7,591,319 | B2 | 9/2009 | Xu | |
| 7,597,152 | B2 * | 10/2009 | Wood et al. | 166/387 |
| 7,642,223 | B2 | 1/2010 | Santra et al. | |
| 2005/0016740 | A1 * | 1/2005 | Aldaz et al. | 166/387 |
| 2007/0295498 | A1 | 12/2007 | Wood et al. | |

* cited by examiner

*Primary Examiner* — Jennifer H Gay
*Assistant Examiner* — Yong-Suk (Philip) Ro
(74) *Attorney, Agent, or Firm* — Steve Rosenblatt

(57) ABSTRACT

An inflatable packer contains a reactive metal in an annular space between the mandrel and the element. A fluid is admitted into the annular space to start a reaction that gives off gas. The generated gas fills the annular space and inflates the element in the process. The actuating fluid can be water and the off gas can be hydrogen. The volume of the reactants can also increase as they swell in the reaction that generates the gas. A valve arrangement associated with the mandrel retains the gas pressure and prevents over-pressurization. The packer can be set in a surrounding tubular or in open hole.

14 Claims, 2 Drawing Sheets

INFLATABLE TOOL SET WITH INTERNALLY GENERATED GAS

FIELD OF THE INVENTION

The field of the invention is subterranean barriers and more particularly inflatables that are set with gas that is internally generated.

BACKGROUND OF THE INVENTION

Barriers are used in subterranean locations to isolate zones in a wellbore. These barriers are known as packers or bridge plugs and come in a variety of designs depending on the application. Some are set in surrounding casing or liner and some are more suited to open hole setting. Typically packers have a sealing element and slips and that assembly is axially compressed so that it extends radially to seal against a surrounding tubular and to hold the seal to the tubular with slips that bite into the surrounding tubular wall. The setting of such packers can be with string manipulation, or using tubing pressure after dropping a ball or even hydrostatic pressures available in the annulus around a string that supports such a packer.

Another packer style is an inflatable that features a flexible element that defines a sealed annular space between itself and a mandrel. A valve assembly admits fluid into the annular space under the element and prevents overpressure while holding in the admitted pressure to maintain the set position. Such inflatables are run into open hole and set and are also run through tubing and set in larger casing among the many possible applications. They are typically inflated with a dropped ball and pressure built on the seated ball that allows fluid past the valve assembly of the packer to inflate it. The sealing element is reinforced for pressure rating as well as to control the manner in which it grows radially to meet the surrounding wellbore wall or surrounding tubular.

Various attempts have been made in the design of inflatables to maintain their set position after inflation in the face of changing wellbore conditions. Temperature changes can affect the internal pressure in the inflatable and some of the ways to compensate for internal pressure changes have involved the insertion of solids in the annular space under the element whose volume can change such as by swelling when the inflate fluid is introduced. This concept is illustrated in U.S. Pat. No. 7,597,152. Another approach is to introduce solids and then let the carrying fluid escape with the idea that the packed in solids will hold the set position of the element as shown in U.S. Pat. No. 7,178,603. U.S. Publication 2007/0295498 illustrates a manufacturing technique for a swelling element that is not an inflatable to control unwanted flow between the mandrel and the element after the swelling occurs.

Techniques for gas generation to place barriers in wellbores are described in U.S. Pat. No. 7,642,223 in the context of placement of a plugging material in the formation to control flow and using the generated gas to aid in such placement. Other applications employ dissolvable metals to generate gas in a downhole tool where the generated pressure is then deployed to move a piston to set a downhole tool. This is described in U.S. Pat. No. 7,591,319.

The present invention deals with a technique for actuation of inflatables with gas generated within the annular space between the element and the mandrel. A reactant is introduced in sufficient quantity within the annular space to initiate the reaction and the gas generation while the actual inflation is accomplished by the generated gas. These and other aspects of the present invention will become more apparent to those skilled in the art from a review of the description of the preferred embodiment and the associated drawings while recognizing that the full scope of the invention is determined by the appended claims.

SUMMARY OF THE INVENTION

An inflatable packer contains a reactive metal in an annular space between the mandrel and the element. A fluid is admitted into the annular space to start a reaction that gives off gas. The generated gas fills the annular space, increases the annular pressure, and inflates the element in the process. The actuating fluid can be water and the generated gas can be hydrogen. The volume of the reactants can also increase as they swell due to the chemical reaction that generates the gas. A valve arrangement associated with the mandrel retains the gas pressure and prevents over-pressurization during and after the reaction. The packer can be set in a surrounding tubular or in open hole.

DETAILED DESCRIPTION OF THE PREFERRED EMBODIMENT

Figure 1:
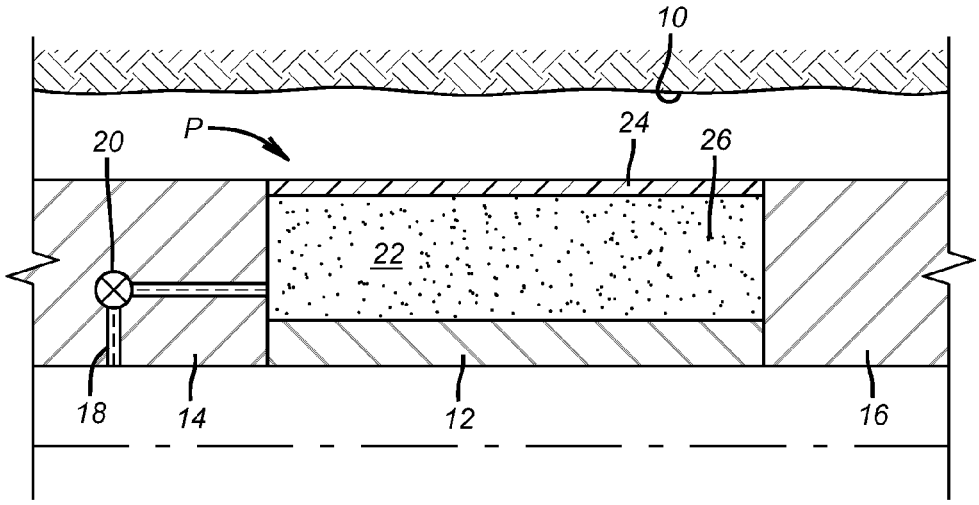
FIG. 1 is the run in position before a reactant that triggers the reaction is admitted through a valve into the annular space below the element.

FIG. 1 shows the packer P in an open hole wellbore 10. The packer P has a mandrel 12 with a top sub 14 and a bottom sub 16 on opposed sides of the mandrel 12. Passage 18 through top sub 14 has a valve assembly 20 that allows flow into chamber or annular space 22 defined between the mandrel 12 and the element 24. The valve assembly 20 not only admits fluid under pressure but it can also regulate the pressure in annular space 22 to prevent overpressure and it also serves to retain the pressure built up in space 22. The valve assembly is of a type well known in the art and is part of the equipment that is used with the present invention. The structure of the inflatable element 24 and its end fixations are also design details known in the art and used in the present invention.

Figure 2:
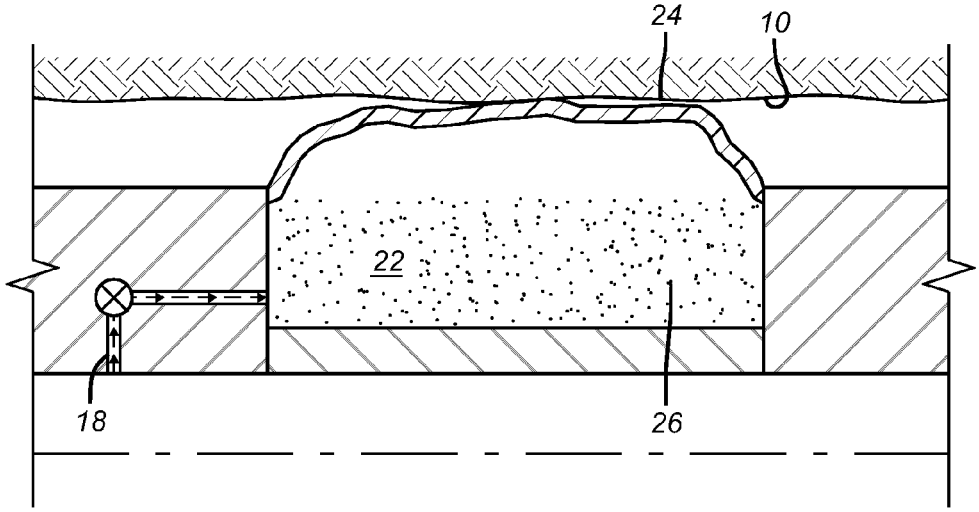
FIG. 2 is the view of FIG. 1 at the outset of the reaction when the gas is generated.
Figure 3:
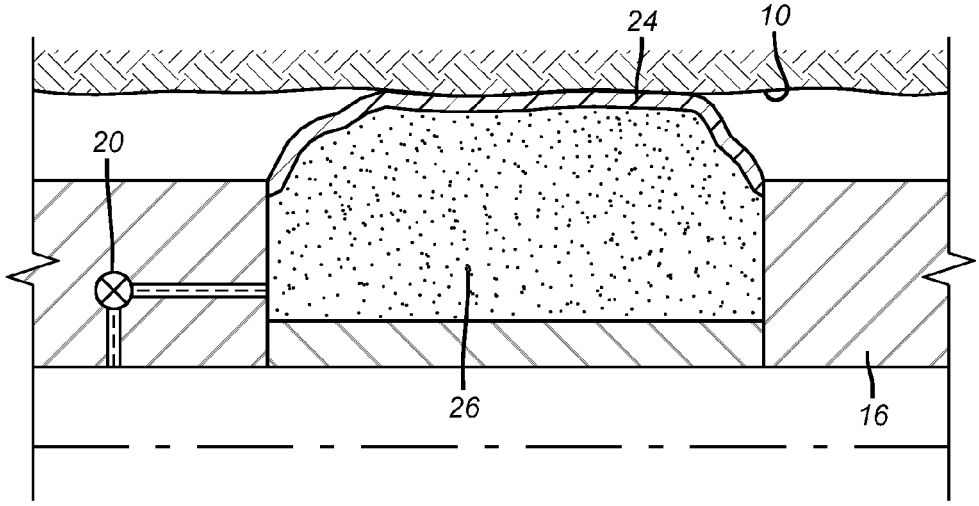
FIG. 3 is the view of FIG. 2 at the conclusion of the reaction showing the gas generated and the growth of the reactive materials holding the set position of the inflatable.
Figure 1A:
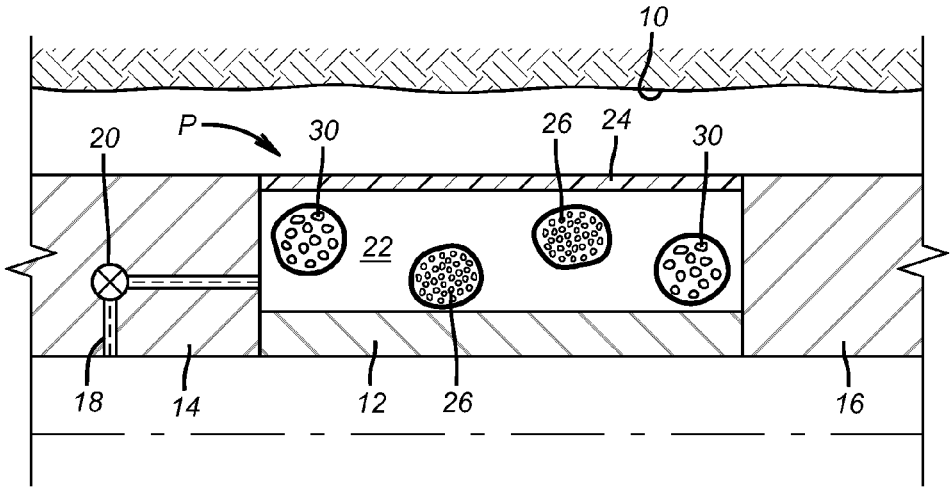
FIG. 1*a* is the run in position before a reactant that triggers the reaction is admitted through a value into the annular space below the element showing the reactants in the space and isolated from each other.
Figure 2A:
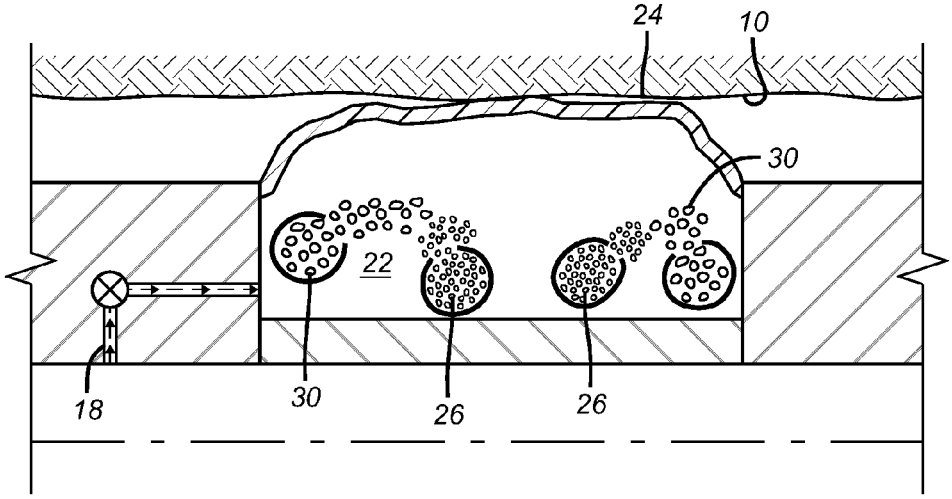
FIG. 2*a* is the view of FIG. 1*a* at the outset of the reaction when the gas is generated as a result of communication between the reactants that are no longer isolated from each other.
Figure 3A:
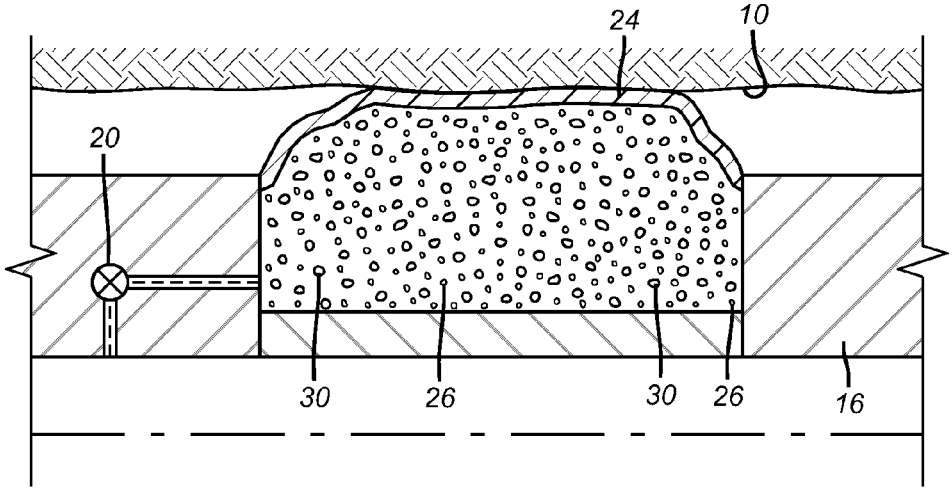
FIG. 3*a* is the view of FIG. 2*a* at the conclusion of the reaction showing the gas generated and the growth of the reactive materials holding the set position of the inflatable.

The space 22 is occupied with preferably a reactive and/or dissolvable metal such as aluminum, tin, magnesium or zinc or combinations of them and preferably water is admitted through passage 18 but in quantities short of inflation of the element 24. The mixing of the water entering at passage 18 and the reactive metal 26 already in space 22 starts the reaction that generates the gas and as shown in FIG. 2 the element moves out radially toward the borehole wall 10 due to increase in pressure. In FIG. 3 the gas generation is complete and the element 24 has taken the shape of the borehole 10 with the valve assembly 20 retaining the generated pressure by the liberated gas from the reaction. During the reaction the reactive material that has reacted has also grown in volume to add to the internal pressure in the space 22. The bottom sub 16 has moved up on mandrel 12 to allow the element 24 to extend out radially into a sealing relation to the borehole 10.

As an alternative the added reactant 30 can be stored in the space 22 but in a manner that is separated from the reactive metal 26 and the two can then be brought into contact at the time it is desired to set the packer P. The water or other trigger fluid can be encapsulated until the desired time and then the barrier can be broken with an applied force, for example. The reactants can be separated by a wall that is breached to allow the reactants to contact as another example. Applied tubing pressure can act to breach the wall.

It should be noted that the added reactant is provided in a small amount so that its added volume may not even cause visible movement in the element 24. Rather it is the volume of generated gas and the increase in internal pressure from the reaction that causes the element 24 to contact and seal against the borehole 10 and to a lesser degree the volume change of the reacted materials also boosts the internal pressure and helps to hold the internal pressure in the space 22 in conjunction with the valve assembly 20. The added material can be water based mud as opposed to plain water. The reaction can also give off some heat which can have a transient effect on the internally generated pressure as the reaction is occurring.

The present invention allows the setting of an inflatable without high pressure fluid or cement pumping equipment and thus saves the operator money and makes it possible to use inflatables where surface conditions of lack of space would have otherwise precluded inflatable use.

The above description is illustrative of the preferred embodiment and many modifications may be made by those skilled in the art without departing from the invention whose scope is to be determined from the literal and equivalent scope of the claims below:

We claim:

1. An inflation method for a subterranean inflatable packer, comprising:

providing an inflatable element mounted to a mandrel with a space therebetween;

providing a valve in a passage in said mandrel to admit and retain a first reactant within said space;

admitting said first reactant through said valve and into said space without inflating said element to a sealing position;

initiating pressure buildup that starts within said space with said first reactant reacting with a second reactant initially placed within said element to generate gas to inflate said element to initially achieve a sealing position held by said valve.

2. The method of claim 1, comprising:

using a chemical reaction to build up pressure.

3. The method of claim 1, comprising:

using swelling of said second reactant to aid in pressure buildup in said space.

4. The method of claim 1, comprising:

using a reactive metal as said second reactant.

5. The method of claim 4, comprising:

using one or more reactive metals selected from the group consisting of aluminum, copper, tin, magnesium and zinc or combinations thereof as said reactive metal.

6. The method of claim 5, comprising:

using water or water based mud to trigger the reaction with said reactive metal.

7. The method of claim 1, comprising:

setting the packer in open hole.

8. The method of claim 1, comprising:

using swelling of reactant material in said space to aid in gas pressure buildup in said space.

9. An inflation method for a subterranean inflatable packer, comprising:

providing an inflatable element mounted to a mandrel with a space therebetween;

initiating pressure buildup that starts within said space to inflate said element;

initially storing all reactive materials needed to generate said pressure buildup separated from each other in said space;

allowing said reactive materials to contact each other in said space to initiate pressure generation.

10. The method of claim 9, comprising:

using a reactive metal as a reactant.

11. The method of claim 10, comprising:

using one or more reactive metals selected from the group consisting of aluminum, copper, tin, magnesium and zinc or combinations thereof as the reactive metal.

12. The method of claim 11, comprising:

using water or water based mud to trigger the reaction with said reactive metal.

13. The method of claim 9, comprising:

setting the packer in open hole.

14. The method of claim 9, comprising:

using swelling of reactant material in said space to aid in pressure buildup in said space.

* * * * *